US006386106B1

(12) United States Patent
Stanka

(10) Patent No.: US 6,386,106 B1
(45) Date of Patent: May 14, 2002

(54) CLEANING APPARATUS FOR THE GRAPHICS INDUSTRY

(75) Inventor: Herbert Stanka, Augsburg (DE)

(73) Assignee: Baldwin Grafotec GmbH (DE)

( * ) Notice: Subject to any disclaimer, the term of this patent is extended or adjusted under 35 U.S.C. 154(b) by 0 days.

(21) Appl. No.: 09/563,655

(22) Filed: May 2, 2000

(30) Foreign Application Priority Data

May 3, 1999 (DE) ..... 199 20 230

(51) Int. Cl.[7] ..... B41F 35/00
(52) U.S. Cl. ..... 101/425; 101/424
(58) Field of Search ..... 101/425, 423, 101/424, 483; 15/256.5, 256.51, 256.52, 256.53; 134/147, 53

(56) References Cited

U.S. PATENT DOCUMENTS

| | | | | |
|---|---|---|---|---|
| 5,005,478 A | * | 4/1991 | Goldberg et al. | 101/425 |
| 5,275,104 A | | 1/1994 | Corrado | 101/425 |
| 5,289,774 A | * | 3/1994 | Stanka | 101/425 |
| 5,303,652 A | * | 4/1994 | Gasparrini et al. | 101/425 |
| 5,304,001 A | * | 4/1994 | Kuo et al. | 366/132 |
| 5,330,576 A | * | 7/1994 | Clauditz | 118/688 |
| 5,373,789 A | | 12/1994 | Waizmann | 101/423 |
| 5,699,738 A | | 12/1997 | Corrado | 101/425 |
| 5,784,962 A | * | 7/1998 | Geis et al. | 101/423 |
| 5,842,418 A | | 12/1998 | Corrado | 101/425 |

FOREIGN PATENT DOCUMENTS

| | | |
|---|---|---|
| DE | 3005469 | 10/1980 |
| DE | 4142422 | 6/1993 |
| DE | 19516422 | 11/1996 |
| DE | 19605957 | 8/1997 |
| EP | 0790125 | 8/1997 |

* cited by examiner

*Primary Examiner*—John S. Hilten
*Assistant Examiner*—Anthony H. Nguyen
(74) *Attorney, Agent, or Firm*—Ostrolenk, Faber, Gerb & Soffen, LLP

(57) ABSTRACT

A cleaning apparatus for a surface, particularly for a surface in the graphics industry and more particularly for the surface of a cylinder used in the graphics industry. A pressing element has a cleaning cloth thereover. The pressing element is movable toward and away from the surface. A pressurizable pressure chamber which when pressurized acts on the pressing element to move the cloth to the surface. A pneumatic circuit feeds compressed air to the pressure chamber and vents the pressure chamber. The circuit includes a compressed air storage chamber which can be alternatively connected to the pressure chamber to pressurize the pressure chamber or to a compressed air source to refill the chamber with compressed air. The volume of the storage chamber and the pressure therein are higher than that of the pressure needed in the pressure chamber for rapid refilling of the pressure chamber. A second air path communicates between the compressed air source and the pressure chamber and includes valving enabling venting of the pressure chamber to maintain a selected pressure level.

14 Claims, 1 Drawing Sheet

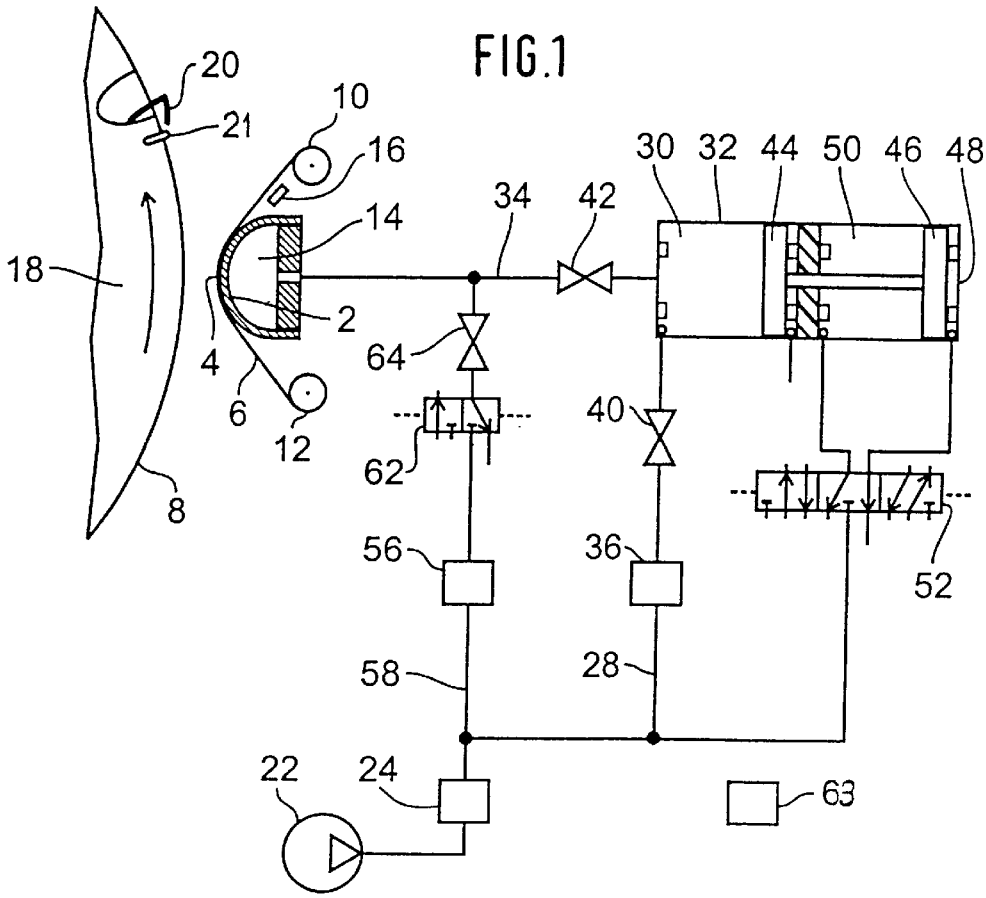
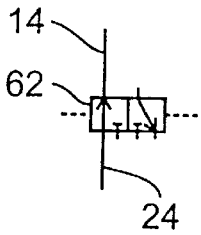
FIG.4
FIG.2
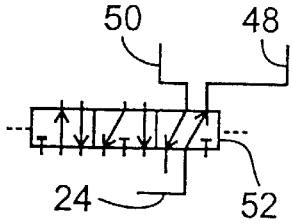
FIG. 3
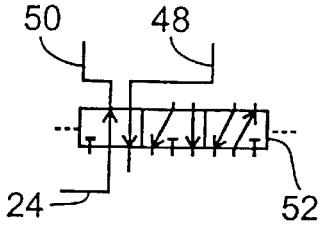

CLEANING APPARATUS FOR THE GRAPHICS INDUSTRY

BACKGROUND OF THE INVENTION

The invention pertains to a cleaning apparatus for cleaning a running dirty surface in a machine in the graphics industry and particularly to a pneumatic pressure apparatus for moving a cleaning cloth to and away from the surface, e.g., of a cylinder.

A cleaning apparatus of this type is disclosed by U.S. Pat. No. 4,344,361 (DE 30 05 469 C2). On its path from a clean cloth roller to a pressing element in the form of an inflatable rubber lip, a cleaning cloth is moistened by a nozzle apparatus. After the rubber lip, the cloth is wound up onto a dirty cloth roller. The onward transport or advance of the cleaning cloth is carried out in each case only when the cleaning cloth is not pressed by the rubber lip against the surface to be cleaned, but is moved out of contact with that surface and, as a result, is at a short distance from it.

Further prior art concerning such apparatus includes DE 196 05 957 A1, DE 195 16 422 C2, DE 41 42 422 A1, DE 30 05 469 C2, U.S. Pat. Nos. 5,842,418, 5,699,738.

Dirty surfaces in machines in the graphics industry, in printing machines, include the various cylinders, such as the blanket cylinders, printing-plate cylinders and impression cylinders, and also paper webs and paper sheets to be printed. In paper cutting machines (slitters or sheet cutters) and in paper coating equipment, further dirty surfaces are the paper webs or paper sheets, and particularly also cylinders and rollers which are used to transport and to treat the paper webs and paper sheets. "Dirt" is, in particular, printing ink and paper dust, but includes any other contamination.

During a cleaning operation, the machine being cleaned continues to run, but without paper sheets or paper webs being able to be printed, if printing ink and other types of contamination are being removed from one of the cylinders, such as a printing-plate cylinder, blanket cylinder or impression cylinder. This means that paper broke (rejects) is produced by the paper running during the cleaning operation. During the cleaning operation, the cleaning cloth is pressed cyclically many times, either by the rubber lip or by another pressing element, against the surface to be cleaned and the cloth is then lifted off the surface again. The cleaning cloth is transported onward by a predetermined cloth section in each case when it is lifted off, in order that when the cloth is again placed against the surface to be cleaned, a fresh cloth section is available.

SUMMARY OF THE INVENTION

The invention is intended to achieve the object of shortening, in a straightforward way, the time required for a cleaning operation.

The invention concerns a cleaning apparatus for a surface and particularly for a surface in the graphics industry and more particularly for the surface of a cylinder in the graphics industry. A pressing element has a cleaning cloth thereover and the pressing element is movable toward and away from the surface. A pressurizable pressure chamber which when pressurized, acts on the pressing element to move the cloth to the surface. A pneumatic circuit feeds compressed air to the pressure chamber and vents the pressure chamber. The circuit includes a compressed air storage chamber which can be alternatively connected to the pressure chamber or the pressure element to pressurize the pressure chamber or connected to a compressed air source to refill the chamber with compressed air. The volume of the chamber and the pressure therein is higher than that of the pressure needed in the pressure chamber for rapid refilling of the pressure chamber. A second air path communicates between the compressed air source and the pressure chamber and includes valving enabling venting of the pressure chamber to maintain a selected pressure level.

The invention provides a cleaning apparatus for cleaning a running dirty surface, wherein the pneumatic circuit contains a compressed-air store with a compressed-air storage chamber, which can be connected alternatively to the pressure chamber of the pressing element, in order to press the pressing element into the in-contact position by means of stored compressed air, or to a compressed-air source, in order to fill that chamber with compressed air again. The volume of the compressed-air storage chamber is less than the volume of the pressure chamber, and the compressed air stored in the compressed-air storage chamber is at a significantly higher pressure than a predetermined desired pressure value to be produced in the pressure chamber in the in-contact position of the pressing element, for the cleaning operation. This causes a high flow velocity of the compressed air from the compressed-air storage chamber into the pressure chamber is achieved.

According to a preferred embodiment of the invention, the compressed-air store has a piston which can be actuated pneumatically to force the stored quantity of compressed air from the compressed-air storage chamber into the pressure chamber of the pressing element.

Furthermore, the invention provides a compressed-air feed line from the compressed-air source to the compressed-air storage chamber which is provided with a pressure regulator which sets the pressure in the compressed-air storage chamber to a value which is significantly higher than the pressure with which the pressing element is to be held in the in-contact position. The pressure value and the volume of the compressed-air storage chamber are selected such that the stored quantity of compressed air is at least as great as the quantity of compressed air which is needed in the pressure chamber to produce the pressure with which the pressing element is to be held in the in-contact position.

In a particularly preferred embodiment of the invention, the compressed-air storage chamber is arranged in a first compressed-air path, which leads from the compressed-air source to the pressure chamber of the pressing element. A second compressed-air path leads from the compressed-air source to the pressure chamber of the pressing element. The second compressed-air path is provided with a pressure regulator which is set to the pressure with which the pressing element is to be held in the in-contact position.

In a further preferred embodiment of the invention, at its downstream end, each of the two compressed-air paths can alternatively be connected to the pressure chamber of the pressing element or isolated from this pressure chamber by a valve arrangement.

The invention is suitable in particular for cleaning printing-machine cylinders and, in particular, also for cleaning impression cylinders in sheet-fed printing machines.

Other objects and features of the invention are described below with reference to the attached drawings and using a preferred embodiment as an example.

BRIEF DESCRIPTION OF THE DRAWINGS

FIG. 1 schematically shows a cleaning apparatus according to the invention for cleaning a running dirty surface in a machine in the graphics industry, for example an impression cylinder in a sheet-fed printing machine, FIG. 2 schematically shows a valve arrangement of FIG. 1 in a position for carrying out a forward stroke of a piston in a compressed-air store of FIG. 1, FIG. 3 shows the valve arrangement of FIG. 2 in a different switching position for a return stroke of the piston, and FIG. 4 shows a further valve arrangement of FIG. 1 in a different switching position than in FIG. 1.

DESCRIPTION OF PREFERRED EMBODIMENTS

The cleaning apparatus illustrated in FIG. 1 contains a pressing element 2, which can move a section 4 of a cleaning cloth 6, which extends over this pressing element, alternately into and out of contact with a running surface 8 to be cleaned.

The cleaning cloth 6 is transported cyclically from a clean cloth roller 10 to a dirty cloth roller 12. Onward transport of the cleaning cloth 6 is carried out in each case when, as shown in FIG. 1, it is in its position out of contact with the surface 8 to be cleaned. When the cloth is in the position in contact with the surface 8 to be cleaned, the cleaning cloth 6 is held at a standstill.

In order to bring the cloth section 4 extending over the pressing element 2 into contact with the surface 8 to be cleaned, the pressing element 2 is expanded toward the surface 8 to be cleaned by means of compressed air in a pressure chamber 14 bounded at least partly by the pressing element. In order to move the pressing element 2 and the cloth section 4 lying on it out of contact with and away from the surface 8 to be cleaned, the pressure chamber 14 is vented.

On its way from the clean cloth roller 10 to the pressing element 2, the cleaning cloth 6 can be moistened with water or another liquid by a moistening device 16. This provides the option of washing the surface 8 to be cleaned in a moist or wet condition and then of drying it with a dry section 4 of the cleaning cloth 6. In a different embodiment, the cloth 6 can also be a pre-moistened cloth, which is already moist when it is on the clean cloth roller 10.

The surface 8 to be cleaned, or the dirty surface, in the embodiment shown in FIG. 1 is the cylindrical peripheral surface of an impression cylinder for printing sheets, for example paper sheets. The leading edge of each sheet, in the direction of rotation 18 of the impression cylinder, is in each case held by grippers 20 on the peripheral surface. After the gripper 20 had been pivoted away, the sheet can be lifted off the circumferential surface by pins 21, in order that the sheets can run onto a transfer device.

In the embodiment illustrated, the pressing element 2 has the form of a rubber lip, but according to different embodiments can also be an inflatable hose or another element, for example an element which can be actuated by one or more cylinders which bound the pressure chamber 14 and, as a result, can be actuated by its pressure.

In order to feed compressed air into the pressure chamber 14 for moving the pressing element 2 with the cloth section 4 into contact with the surface 8 to be cleaned, and subsequently to vent the pressure chamber 14 in order that the pressing element 2 moves back again from the surface 8 to be cleaned as a result of its material elasticity, a pneumatic circuit as shown in FIG. 1 is provided.

The pneumatic circuit contains a compressed-air source 22 with a compressed-air regulator 24 and two parallel compressed-air paths, via which the outlet of the pressure regulator 24 of the compressed-air source 22 can be provided with a flow connection to the pressure chamber 14 of the pressing element 2. One compressed-air path, starting from the outlet of the pressure regulator 24 of the compressed-air source 22, contains, in sequence, a feed line 28 to a compressed-air storage chamber 30 and an outgoing line 34 from the compressed-air storage chamber 30 to the pressure chamber 14 of the pressing element 2. The feed line 28 contains a pressure regulator 36, which sets the pressure in the compressed-air storage chamber 30 to a value which is significantly higher than the pressure with which the pressing element 2 is to be held in the in-contact position. In the feed line 28, between the pressure regulator 36 and the compressed-air storage chamber 30, there is a first on/off valve 40. There is a second on/off valve 42 in the outgoing line 34.

The desired pressure value set on the pressure regulator 36 of the feed line 28 and the volume of the compressed-air storage chamber 30 are chosen such that the quantity of compressed air which can be stored in the compressed-air storage chamber 30 is at least as great as or greater than the quantity of compressed air which is needed in the pressure chamber 14 to produce sufficient pressure to hold the pressing element 2 in the in-contact position.

FIG. 1 shows the unpressurized state of the compressed-air storage chamber 30 and of the pressure chamber 14. To fill the compressed-air storage chamber 30 with compressed air, the second valve 42 is closed and the first valve 40 is opened.

The compressed-air store 32 contains a piston 44 which can be pneumatically actuated to force the stored quantity of compressed air from the compressed-air storage chamber 30 into the pressure chamber 14 of the pressing element 2.

In the embodiment of FIG. 1, the piston 44 is mechanically connected for axial motion to a control piston 46. The control piston 46 has a forward stroke pressure side 48 and a return stroke pressure side 50. Both sides 48 and 50 are vented via a valve arrangement 52.

FIG. 2 shows a switching position of the valve arrangement 52. The forward stroke pressure side 48 is connected to the outlet of the pressure regulator 24 of the compressed-air source 22, so that a quantity of compressed air stored in the compressed-air storage chamber 30 is forced into the pressure chamber 14 if the first on/off valve 40 is closed and the second on/off valve 42 is open.

In order to return the piston 44 from the forward stroke position into the return stroke position shown in FIG. 1, the valve arrangement 52 is changed into the switching position shown in FIG. 3. In this switching position, the forward stroke pressure side 48 is vented and the return stroke pressure side 50 is connected to the outlet of the pressure regulator 24 of the compressed-air source 22. Depending on the desired type of method, during this return stroke of the piston 44, one or other of the two valves 40 and 42 can be open or closed.

To refill the compressed-air storage chamber 30 with the quantity of compressed air needed to actuate the pressing element 2, the second valve 42 of the outgoing line 34 is closed and the first valve 40 of the feed line 28 is opened.

According to a modified embodiment (not shown) the piston 44 can be moved back into the return stroke position shown in FIG. 1 as a result of the filling of the compressed-air storage chamber 30 with compressed air. In this case, the return stroke side 50 of the control piston 46 need not be able to be connected to the compressed-air source 22.

A second compressed-air path leads from the outlet of the pressure regulator 24 of the compressed-air source 22, along a path parallel to the first compressed-air path, into the pressure chamber 14 of the pressing element 2. The second compressed-air path contains a further compressed-air regulator 56 in a feed line 58. In addition, this second pressure line path between the further pressure regulator 56 and the pressure chamber 14 of the pressing element 2 contains a further valve arrangement 62, with which the further pressure regulator 52 can alternatively be connected to the pressure chamber 14 or isolated from it. In the switching position shown in FIG. 1 of the further valve arrangement 62, the further pressure regulator 56 is isolated from the pressure chamber 14, and the pressure chamber 14 is vented into the atmosphere.

The further pressure regulator 56 is set to a desired pressure value which is approximately as high as the pressure with which the pressing element 2 is to be held in the in-contact position, that is in the position in which the pressing element 2 presses the cleaning cloth section 4 onto the surface 8 to be cleaned.

The further pressure regulator 56 sets the pressure on its outlet side to this pressure value, both in the event of upward pressure fluctuations and in the event of downward pressure fluctuations. This means that the further pressure regulator 56 vents the pressure chamber 14 when the pressure in the chamber 14 rises above the desired value. On the other hand, the pressure regulator 56 opens in order to feed further compressed air from the compressed-air source 52 when the pressure in the pressure chamber 14 falls below the desired value.

Thus, only the pressure of the pressure regulator 36 in the first compressed-air path is set to be significantly higher than the desired value which is needed in the pressure chamber 14 in order to press the cleaning cloth onto the surface 8 to be cleaned, while the pressure regulator 56 in the second compressed-air path is set to a desired value which is essentially as high as the pressure value needed in the pressure chamber 14 to bring the pressing element 2 into contact with the surface 8 to be cleaned.

The foregoing apparatus achieves the following:

The pressure chamber 14 is quickly filled by the over pressured compressed air from the compressed-air storage chamber 30. This moves the pressing element 2 forward quickly from the out-of-contact position shown in FIG. 1 into the position in contact with the surface 8 to be cleaned. Any excess pressure which develops in the pressure chamber 14 is corrected via the pressure regulator 56 in the second pressure line path. According to another embodiment, this correction could also be made by an additional overpressure valve. However, the further pressure regulator 56 in the second pressure line path has the effect that if the pressure in the pressure chamber 14 falls below the desired value, the desired value is immediately established again. This is advantageous in the case of an impression cylinder for sheet-fed printing machines, since increased pressure in the pressure chamber 14 is produced briefly by the grippers 20 pressing against the pressing element 2, and, as a result, the pressure chamber 14 is vented by the further pressure regulator 56 (or by an overpressure valve). After the grippers 20 have passed the pressing element 2, there is a slight lack of pressure in the pressure chamber 14. This lack of pressure is detected by the further pressure regulator 56 and balanced out immediately.

An electronic and/or program-controlled control device 63 is provided in order to control the valves 40 and 42 and the valve arrangements 52 and 62.

The second compressed-air path contains an on/off valve 64 between the valve arrangement 62 and the pressure chamber 14 of the pressing element 2. This valve is closed when the compressed air under high pressure is delivered from the compressed-air storage chamber 30 into the pressure chamber 14 to prevent the compressed air escaping via the valve arrangement 62 and/or via the pressure regulator 56 of the second compressed-air path. The on/off valve 64 is opened, for example only fractions of a second later, after the pressure in the compressed-air storage chamber 30 has been relieved into the pressure chamber 14, to a pressure value which essentially corresponds to the compressed-air value set on the pressure regulator 56 of the second compressed-air path. In a modified embodiment, the on/off valve 64 can be replaced with a different valve arrangement 62 which fulfills the same function, for example, a valve arrangement identical to the valve arrangement 52 for controlling the control piston 46.

If the pressure regulator 36 in the first compressed-air path is not a permanently set pressure regulator but one which can be set variably, then the complete pneumatic circuit can be used for pressure chambers 14 of different sizes, for example for pressure chambers 14 of different lengths along a cylinder, corresponding to cylinders of different lengths having a surface 8 to be cleaned.

Instead of the valve arrangement 52 for controlling the control piston 46, a different valve arrangement can also be used, for example a so-called 5/2-way valve, which has 5 line connections and two different valve positions.

A preferred operating method of the invention is described.

1. In the starting situation, the valve 42 is closed and the pressure chamber 14 is vented into the external atmosphere via the opened valve 64 and the valve arrangement 62. The compressed-air storage chamber 30 is filled via the opened valve 40, for example with a pressure of 5 bar, set on the pressure regulator 36, and a volume of the compressed-air storage chamber 30 of one liter.
2. Close the valves 64 and 40.
3. Open the valve 42 and, as a result, relieve the pressure of the compressed-air storage chamber 30 into the pressure chamber 14, which is significantly larger than the compressed-air storage chamber 30. This produces the contact pressure to be produced in the pressure chamber in order to move the pressing element 2 into contact with the surface 8 to be cleaned, and the contact pressure to be produced during the cleaning, which may be 0.4 bar, for example.
4. Close the valve 42 and, at the same time or later after a delay, close the valve 64, switch the valve arrangement 62 to straight through and switch the valve 40 to straight through. Now the pressure in the pressure chamber 14 is regulated by the pressure regulator 56, and the compressed-air storage chamber 30 is filled again to 5 bar with compressed air via the pressure regulator 36 and the opened valve 40.
5. Vent the pressure chamber 14 via the opened valve 64 and the valve arrangement 62, which for this purpose is changed over from the straight-through position into the venting position shown in FIG. 1. This lifts the pressing element 2 off the surface to be cleaned. Then advance the cleaning cloth 6 by one cloth section 4.
6. Perform a predetermined number of repetitions of the above steps 2 to 5.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A cleaning apparatus for cleaning a running surface in a machine, the apparatus comprising:

a cleaning cloth;

a pressing element movable toward engagement with the running surface and movable away from the surface, the pressing element supporting the cleaning cloth extending over the pressing element to bring the cloth into and out of contact with the surface;

a pressure chamber communicating with the pressing element and being pressurizable for operating the pressing element to press the cloth in contact with the surface; and a pneumatic circuit for selectively feeding compressed air to the pressure chamber for pressing the pressing element toward the surface and for venting the pressure chamber for permitting the pressing element to move away from the surface, the pneumatic circuit comprising:

a compressed air source; and a compressed air storage chamber selectively connectable alternatively to the pressure chamber of the pressing element to press the pressing element toward the surface using compressed air flowing from the storage chamber, or to the compressed air source for filling the storage chamber with compressed air;

wherein at least one of the volume of the storage chamber is greater than the volume of the pressure chamber; and the pressure level of the compressed air stored in the storage chamber is selected so that the compressed air in the storage chamber is at a significantly higher pressure than a predetermined pressure value that is to be produced in the pressure chamber for the pressing element when the pressing element is pressed toward the surface for cleaning, thereby producing a high velocity flow of compressed air from the storage chamber into the pressure chamber.

2. The apparatus of claim 1, further comprising supports for the cleaning cloth for enabling the cleaning cloth to pass over the pressing element and for selectively transporting the cleaning cloth across the pressing element when the cleaning cloth is out of contact with the surface for bringing a new section of the cleaning cloth in a position to contact the surface for cleaning.

3. The cleaning apparatus of claim 1, wherein the surface is a surface in a machine in the graphics industry, the pressing element being shaped and positioned for moving the cloth against the surface.

4. The apparatus of claim 3, wherein the surface being cleaned is the surface of a cylinder in a graphics industry machine.

5. The cleaning apparatus of claim 1, further comprising a piston in the compressed air storage chamber and pneumatic connections to the piston for selectively pneumatically forcing the stored quantity of compressed air from the compressed air storage chamber into the pressure chamber.

6. The cleaning apparatus of claim 1, further comprising:

a first compressed air feed line from the pressure source to the compressed air storage chamber;

a first pressure regulator in the first air feed line operable for setting a pressure in the compressed air storage chamber which is significantly higher than the pressure for holding the pressing element to the surface, the first pressure regulator being operable for setting the pressure value in the storage chamber in conformity with the volume of the storage chamber so that the stored quantity of compressed air in the storage chamber is at least as great as the quantity of compressed air needed in the pressure chamber for producing the pressure for pressing the pressing element to the surface.

7. The cleaning apparatus of claim 6, further comprising:

a second compressed air path from the compressed air source to the pressure chamber;

a second pressure regulator in the second compressed air path set to a pressure with which the pressing element is pressed to at the surface, whereby if the pressure in the pressure chamber is above the pressure with which the pressing element is to be held to the surface, the second pressure regulator reduces the pressure in the pressure chamber to the level for pressing the pressing element to the surface.

8. The cleaning apparatus of claim 7, wherein the second pressure regulator in the second compressed air path is operable in the event of both upward and downward pressure deviations to regulate the pressure at the side thereof that is connectable to the pressure chamber to set the level of pressure in the pressure chamber.

9. The cleaning apparatus of claim 7, wherein both of the first compressed air feed line and the second compressed air path are connected with the pressure chamber, the cleaning apparatus further comprising;

a first valve between the pressure chamber and the first compressed air feed line for selectively opening the connection or closing that connection; and a second valve between the pressure chamber and the second compressed air path for selectively opening and closing the connection between the pressure chamber and the second compressed air path.

10. The cleaning apparatus of claim 1, further comprising a first compressed air path leading from the compressed air source to the pressure chamber and a second compressed air path leading from the compressed air source to the pressure chamber; a pressure regulator in the second compressed air path set to a pressure with for pressing the pressing element to the surface, whereby if the pressure in the pressure chamber is above the pressure with which the pressing element is to be pressed toward the surface, the pressure regulator in the second path reduces the pressure in the pressure chamber to the level for pressing the pressing element to the surface.

11. The cleaning apparatus of claim 3, wherein the surface to be cleaned is the peripheral surface of a printing machine cylinder.

12. The cleaning apparatus of claim 11, wherein the cylinder is an impression cylinder of a sheet fed printing machine.

13. A cleaning apparatus for cleaning a running surface in a machine, the apparatus comprising:

a cleaning cloth;

a pressing element movable toward engagement with the running surface and movable away from the surface, the pressing element supporting the cleaning cloth extending over the pressing element to bring the cloth into and out of contact with the surface;

a pressure chamber communicating with the pressing element and being pressurizable for operating the pressing element to press the cloth in contact with the surface;

a first compressed air feed line from the pressure source to the compressed air storage chamber;

a first pressure regulator in the first air feed line operable for setting a pressure in the compressed air storage chamber which is significantly higher than the pressure for holding the pressing element to the surface, the first pressure regulator being operable for setting the pressure value in the storage chamber in conformity with the volume of the storage chamber so that the stored quantity of compressed air in the storage chamber is at least as great as the quantity of compressed air needed in the pressure chamber for producing the pressure for pressing the pressing element to the surface; and a pneumatic circuit for selectively feeding compressed air to the pressure chamber for pressing the pressing element toward the surface and for venting the pressure chamber for permitting the pressing element to move away from the surface, the pneumatic circuit comprising:

a compressed air source; and a compressed air storage chamber selectively connectable alternatively to the pressure chamber of the pressing element to press the pressing element toward the surface by compressed air from the storage chamber, or to the compressed air source for filling the storage chamber with compressed air, such that a high velocity flow of compressed air is produced from the storage chamber into the pressure chamber for pressing the pressing element to the surface.

14. The cleaning apparatus of claim 13, further comprising:

a second compressed air path from the compressed air source to the pressure chamber;

a second pressure regulator in the second compressed air path set to a pressure with which the pressing element is pressed to at the surface, whereby if the pressure in the pressure chamber is above the pressure with which the pressing element is to be held to the surface, the second pressure regulator reduces the pressure in the pressure chamber to the level for pressing the pressing element to the surface.

* * * * *